US010001140B2

(12) United States Patent
Chen

(10) Patent No.: US 10,001,140 B2
(45) Date of Patent: Jun. 19, 2018

(54) FAN COVER WITH PLURALITY OF OPENINGS

(71) Applicant: Hewlett-Packard Development Company, L.P., Houston, TX (US)

(72) Inventor: Fu-Yi Chen, Taipei (TW)

(73) Assignee: Hewlett-Packard Development Company, LP., Houston, TX (US)

( * ) Notice: Subject to any disclaimer, the term of this patent is extended or adjusted under 35 U.S.C. 154(b) by 298 days.

(21) Appl. No.: 14/802,125

(22) Filed: Jul. 17, 2015

(65) Prior Publication Data

US 2017/0016456 A1 Jan. 19, 2017

(51) Int. Cl.
*F04D 29/58* (2006.01)

(52) U.S. Cl.
CPC ..... *F04D 29/582* (2013.01)

(58) Field of Classification Search
None
See application file for complete search history.

(56) References Cited

U.S. PATENT DOCUMENTS 5,445,215 A * 8/1995 Herbert ..... F04D 29/547 165/125
6,311,767 B1 * 11/2001 Inoue ..... F28D 15/0275 165/104.33
6,407,921 B1 * 6/2002 Nakamura ..... G06F 1/203 165/104.33
6,650,540 B2 11/2003 Ishikawa
6,867,971 B2 * 3/2005 Lai ..... H01L 23/427 165/104.33
7,212,404 B2 * 5/2007 Wang ..... H01L 23/427 257/E23.088
7,333,332 B2 * 2/2008 Wang ..... H01L 23/427 165/121
7,688,590 B2 * 3/2010 Cheng ..... G06F 1/203 165/104.33
8,050,033 B2 11/2011 Ishikawa
8,289,699 B2 10/2012 Hwang et al.
8,757,963 B2 6/2014 Chou
2008/0043436 A1 2/2008 Hung et al.
2009/0014160 A1 1/2009 Hsiao
(Continued)

OTHER PUBLICATIONS

Allen Campbell ~ MSI FX600 Laptop Review (with nVidia Optimus Technology) ~ KitGuru ~ Part 4 ~ Feb. 2015 ~ 3 pages.

*Primary Examiner* — Woody Lee, Jr.
*Assistant Examiner* — Theodore Ribadeneyra
(74) *Attorney, Agent, or Firm* — HP Inc. Patent Department

(57) ABSTRACT

Example implementations relate to a fan cover with a plurality of openings. For example, a device may include a fan cover to a fan device and a heat conduction device, a portion of the heat conduction device being coupled to an inside surface of the fan cover. The fan cover provides airflow for heat dissipation in a computing device and surrounds at least a portion of the fan device. The fan device has a first side associated with an axis about which an impeller of the fan device is capable of rotating and a second side associated with blade edges of the impeller of the fan device. The fan cover includes a flat portion to surround the first side and a curved portion to surround the second side, the curved portion having a plurality of openings such that airflow produced by the fan device is capable of passing through.

20 Claims, 3 Drawing Sheets

(56) References Cited

U.S. PATENT DOCUMENTS

| | | | | |
|---|---|---|---|---|
| 2009/0135563 | A1* | 5/2009 | Sakata | F16M 11/10 361/697 |
| 2010/0230076 | A1* | 9/2010 | Yang | F04D 25/0613 165/104.26 |
| 2011/0017430 | A1 | 1/2011 | Lian et al. | |
| 2011/0290452 | A1* | 12/2011 | Tracy | G06F 1/20 165/104.26 |
| 2013/0250518 | A1* | 9/2013 | Chiang | H05K 7/20154 361/697 |
| 2014/0290918 | A1 | 10/2014 | Chen | |

* cited by examiner

FAN COVER WITH PLURALITY OF OPENINGS

BACKGROUND

Computing devices contain components that, when operated, release heat. To prevent damage to the components in the computing device, a fan device may be used to dissipate this heat.

BRIEF DESCRIPTION OF THE DRAWINGS

Some examples of the present application are described with respect to the following figures.

DETAILED DESCRIPTION

As described above, a fan device may be used to dissipate heat released from components of a computing device. The fan device may be attached to aluminum fins that provide ventilation for the heat. A heat dissipation cooling assembly for a computing device may include the fan device, a fan cover to protect the fan device, aluminum fins to provide a heat dissipation area and ventilation, and a heat pipe to transfer heat generated by a component(s) of the computing device to the heat dissipation cooling assembly.

To reduce the number of components of a heat dissipation cooling assembly for a computing device, a fan cover having a plurality of openings, as disclosed herein, may be used to create an assembly without the aluminum fins. For example, the finless fan cover may cover a fan device and may extend beyond the fan device, where the portion that extends beyond the fan device s a curved portion of the fan cover having a plurality of openings that increase the heat dissipation areas and allow ventilation.

Figure 1:
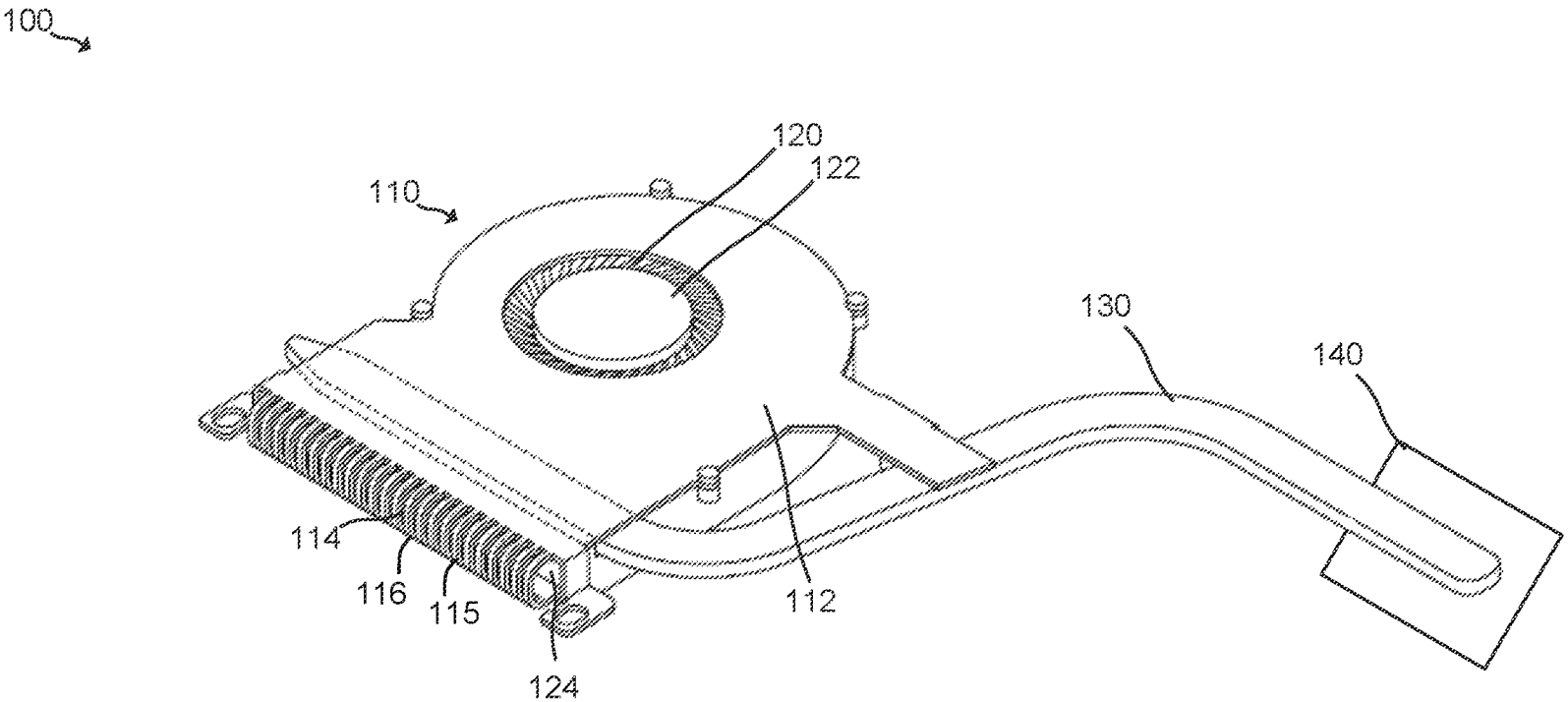
FIG. 1 is a schematic diagram of the outside of an example device with a fan cover having a plurality of openings.

Referring now to the figures, FIG. 1 is a schematic of the outside of an example device 100 with a fan cover 110 having a plurality of slats 115 that define a plurality of openings 116. The device 100 may include the fan cover 110, a fan device 120, a heat conduction device 130, and a component 140 of a computing device.

The fan device 120 may be any suitable fan device capable of providing airflow by rotating the impellers of the fan device 120. The fan device may have a first side 122 associated with an axis about which an impeller of the fan device 120 is capable of rotating and a second side 124 associated with blade edges of the impeller of the fan device 120.

The heat conduction device 130 may be any suitable device capable of conducting and sending heat from the component 140 of the computing device to a plurality of openings in the fan cover 110. In some examples, the heat conduction device 130 may be a heat pipe. The heat conduction device 130 may be coupled to an inside surface of the fan cover in any suitable manner, as shown by the dotted lines on the heat conduction device 130. For example, the heat conduction device 130 may be soldered to the flat portion 112 of the fan cover 110 adjacent to the curved portion 114 such that heat from the heat conduction device 130 is capable of passing through the plurality of openings.

The component 140 of the computing device may be any suitable component of the computing device, such as a processor of the computing device (e.g., a central processing unit (CPU), a graphics processing unit (GPU), etc.), a printed circuit board of the computing device, a heat sink, a conductive plate (e.g., a metal plate) to conduct heat from another component of the computing device, and the like. The component 140 may generate heat when operated, and that heat may be transferred from the component 140 to the fan cover 110 via the heat conduction device 130.

The fan cover 110 may be made of any suitable material (e.g., plastic, a metal such as aluminum, etc.) and may be used to surround at least a portion of the fan device 120. The fan cover 110 may include a flat portion 112 to surround the first side 122 of the fan device (e.g., the side 122 associated with an axis about which an impeller of the fan device 120 is capable of rotating) and may also include a curved portion 114 to surround the second side 124 of the fan device (e.g., the side 124 associated with blade edges of the impeller of the fan device). The curved portion 114 may include a plurality of openings such that the airflow produced by the fan device is capable of passing through the plurality of openings. The plurality of openings may provide airflow and forced convection flow for heat dissipation in the computing device. For example, the plurality of openings may allow heat from the component 140 of the computing device to be dissipated.

Figure 2:
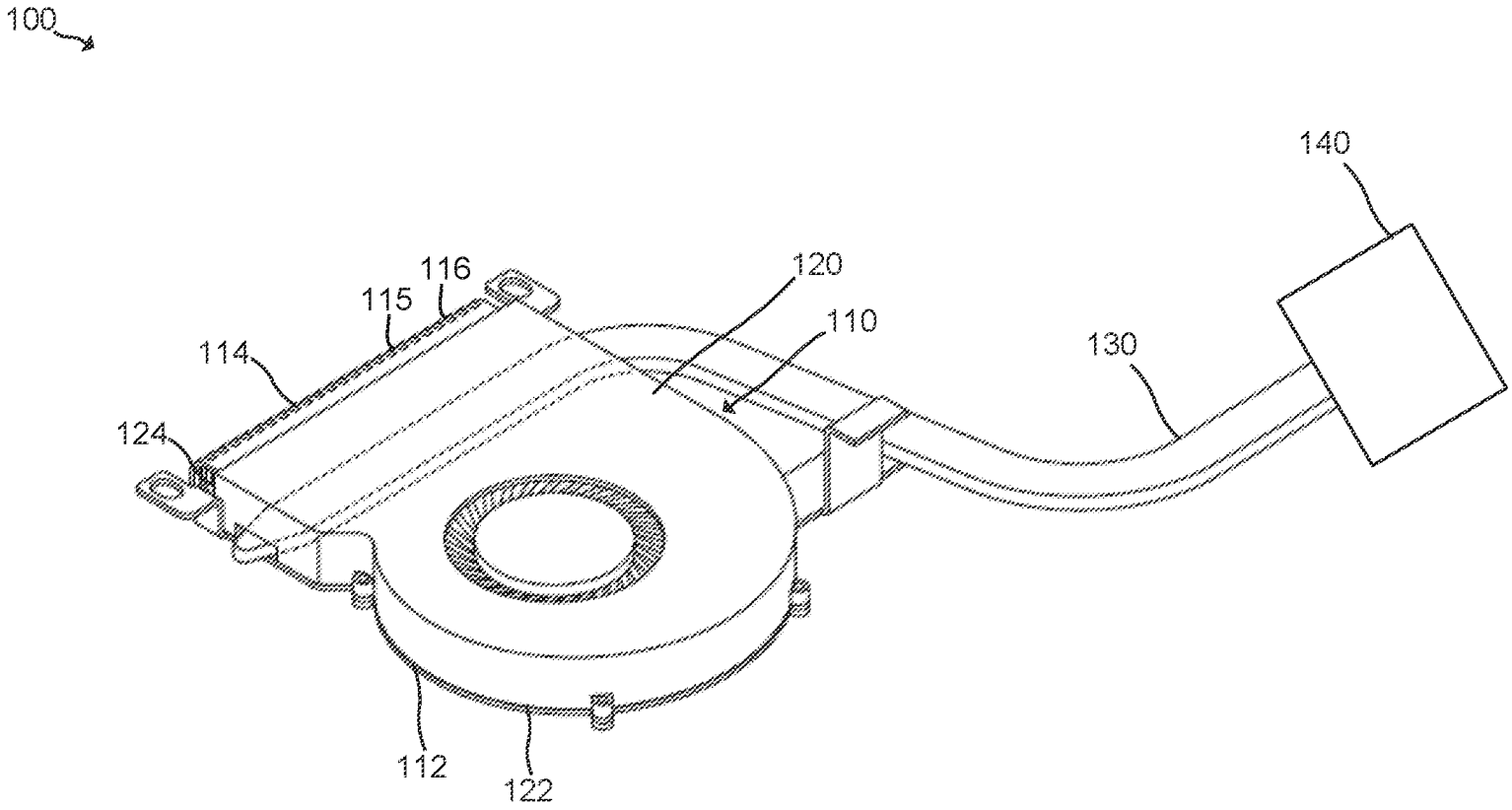
FIG. 2 is a schematic diagram of the outside of an example apparatus with a fan cover having a plurality of openings.

FIG. 2 is a schematic diagram of the outside of an example device 100 with a fan cover 110 having a plurality of slats 115 that define a plurality of openings 116 (e.g., the opposite side view of the device 100 and its components shown in FIG. 1). As shown in FIG. 2, the device 100 may be an apparatus that includes the heat conduction device 130 (e.g., a heat pipe) coupled to the component 140 of the computing device as well as the fan cover 110 to the fan device 120. The fan cover 110 may provide airflow for heat dissipation in the computing device and may surround at least a portion of the fan device 120. For example, the fan cover 110 may include a flat portion 112 to surround the first side 122 of the fan device 120 (e.g., the side 122 associated with an axis about which an impeller of the fan device 120 is capable of rotating) and a curved portion 114 to surround the second side 124 of the fan device 120 (e.g., the side 124 associated with blade edges of the impeller of the fan device 120).

Figure 3:
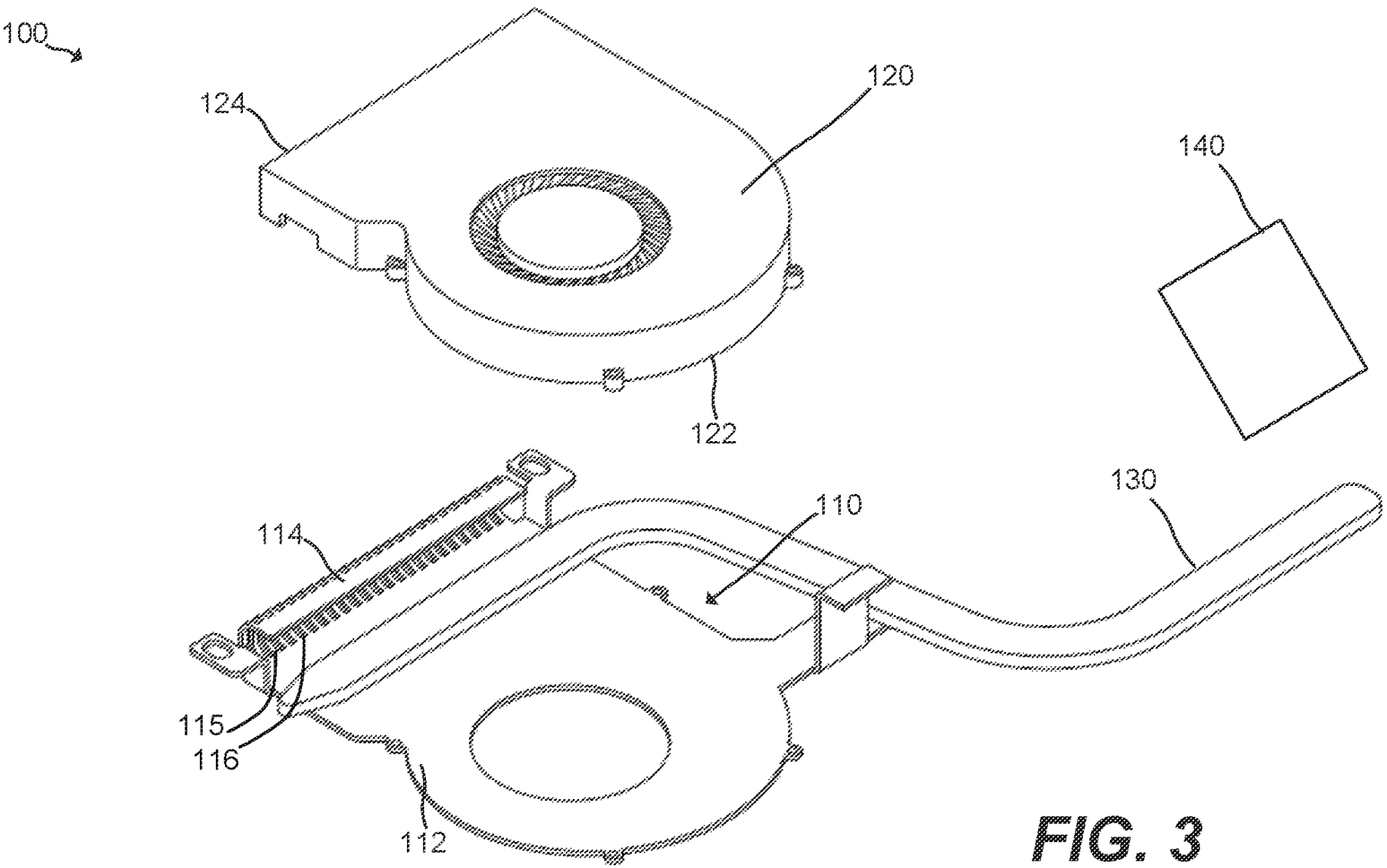
FIG. 3 is a schematic diagram illustrating an exploded view showing the inside of an example device with a fan cover having a plurality of openings.

FIG. 3 is a schematic diagram illustrating an exploded view showing the inside of an example device 100 with a fan cover 110 having a plurality of slats 115 that define a plurality of openings 116 (e.g., the inside view of the device 100 and its components shown in FIG. 1). FIG. 3 shows the components of FIGS. 1 and 2, where the fan device 120 and the component 140 of the computing device are uncoupled from the fan cover 110 and the heat conduction device 130. The device 100 may include the heat conduction device 130 (e.g., a heat pipe) that may be coupled to the component 140 of the computing device, the fan device 120, and the fan cover 110. As shown in FIG. 3, the heat conduction device 130 may be disposed on an inside surface of the fan cover 110 such that the heat from the heat conduction device 130 may be directed toward the plurality of openings in the fan cover 110 by the fan device 120.

What is claimed is:

1. A device, comprising:

a fan device, the fan device having a first side associated with an axis about which an impeller of the fan device is capable of rotating and a second side associated with blade edges of the impeller of the fan device;

a fan cover to surround at least a portion of the fan device, the fan cover to provide airflow for heat dissipation in a computing device, the fan cover comprising:

a flat portion to surround the first side of the fan device; and a finless curved portion comprising three sides to enclose the second side of the fan device, the curved portion having a plurality of slats that define a plurality of openings that extend on all three sides of the finless curved portion such that the airflow produced by the fan device is capable of passing through the plurality of openings; and a heat conduction device, wherein a portion of the heat conduction device is coupled to an inside surface of the fan cover, wherein the curved portion and the plurality of slats do not contact the heat conduction device.

2. The device of claim 1, wherein the fan cover is made of a metal.

3. The device of claim 1, wherein the fan cover is made of a plastic.

4. The device of claim 1, wherein the heat conduction device is to send heat from a component of the computing device to the plurality of openings.

5. The device of claim 1, wherein the heat conduction device is soldered to the flat portion of the fan cover adjacent to the curved portion such that heat from the heat conduction device is capable of passing through the plurality of openings.

6. The device of claim 1, wherein the plurality of openings allows heat from a component of the computing device to be dissipated.

7. The device of claim 1, wherein the heat conduction device is a heat pipe.

8. An apparatus, comprising:

a heat pipe coupled to a component of a computing device; and a fan cover to a fan device, the fan cover to provide airflow for heat dissipation in the computing device, the fan cover to surround at least a portion of the fan device, the fan device having a first side associated with an axis about which an impeller of the fan device is capable of rotating and a second side associated with blade edges of the impeller of the fan device, wherein a portion of the heat pipe is disposed on an inside surface of the fan cover, the fan cover comprising:

a flat portion to surround the first side of the fan device; and a finless curved portion comprising three sides to enclose the second side of the fan device, the curved portion having a plurality of slats that define a plurality of openings that extend on all three sides of the finless curved portion such that the airflow produced by the fan device is capable of passing through the plurality of openings, wherein the curved portion and the plurality of slats do not contact the heat pipe.

9. The apparatus of claim 8, wherein the fan cover is made of a metal.

10. The apparatus of claim 8, wherein the fan cover is made of a plastic.

11. The apparatus of claim 8, wherein the heat pipe is to send heat from the component of the computing device to the plurality of openings.

12. The apparatus of claim 8, wherein the heat pipe is soldered to the fan cover.

13. The apparatus of claim 8, wherein the component of the computing device is a processor of the computing device, the heat pipe to transfer heat from the processor to the plurality of openings.

14. The apparatus of claim 8, wherein the component of the computing device is a printed circuit board of the computing device, the heat pipe to transfer heat from the printed circuit board to the plurality of openings.

15. A device, comprising:

a heat pipe coupled to a component of a computing device;

a fan device having a first side associated with an axis about which an impeller of the fan device is capable of rotating and a second side associated with blade edges of the impeller of the fan device; and a fan cover to surround at least a portion of the fan device, the fan cover to provide airflow for heat dissipation in the computing device, wherein a portion of the heat pipe is disposed on an inside surface of the fan cover, the fan cover comprising:

a flat portion to surround the first side of the fan device; and a finless curved portion comprising three sides to enclose the second side of the fan device, the curved portion having a plurality of slats that define a plurality of openings that extend on all three sides of the finless curved portion such that the airflow produced by the fan device is capable of passing through the plurality of openings, wherein the curved portion and the plurality of slats do not contact the heat pipe.

16. The device of claim 15, wherein the fan cover is made of a metal or a plastic.

17. The device of claim 15, wherein the heat pipe is soldered to the fan cover.

18. The device of claim 15, wherein the heat pipe is to send heat from the component of the computing device to the plurality of openings.

19. The device of claim 15, wherein the component of the computing device is a processor of the computing device, the heat pipe to transfer heat from the processor to the plurality of openings.

20. The device of claim 15, wherein the component of the computing device is a printed circuit board of the computing device, the heat pipe to transfer heat from the printed circuit board to the plurality of openings.

* * * * *